United States Patent [19]

Johnson

[11] Patent Number: 4,807,589

[45] Date of Patent: Feb. 28, 1989

[54] DRAFT OPERATED FIREPLACE INSERT

[76] Inventor: Willard D. Johnson, Rte. 1, Box 360-5, Forsyth, Mo. 65653

[21] Appl. No.: 137,594

[22] Filed: Dec. 24, 1987

[51] Int. Cl.[4] ..... F24B 7/00

[52] U.S. Cl. ..... 126/518; 126/163 R; 126/242; 126/510; 126/527; 126/530; 126/533

[58] Field of Search ..... 126/121, 122, 130, 129, 126/131, 138, 139, 140, 143, 163 R, 242

[56] References Cited

U.S. PATENT DOCUMENTS

| | | | |
|---|---|---|---|
| 1,128,358 | 2/1915 | Peake | 126/121 |
| 1,313,085 | 8/1919 | Greene | 126/121 |
| 3,756,218 | 9/1973 | Simpson | 126/121 |
| 4,114,590 | 9/1978 | Frahm | 126/121 |
| 4,149,519 | 4/1979 | Moncrieff-Yeates | 126/242 |
| 4,161,168 | 7/1979 | Cagle | 126/121 X |
| 4,170,217 | 10/1979 | Mayes | 126/121 |
| 4,170,218 | 10/1979 | Hartley | 126/121 |
| 4,180,053 | 12/1979 | Patel | 126/121 X |
| 4,183,347 | 1/1980 | Newswanger | 126/121 |
| 4,257,390 | 3/1981 | Synan | 126/121 |
| 4,441,481 | 4/1984 | Verhaegen | 126/121 |
| 4,445,497 | 5/1984 | Kilday, Sr. | 126/121 |
| 4,574,772 | 3/1986 | Nagel | 126/120 |

FOREIGN PATENT DOCUMENTS

| | | |
|---|---|---|
| 2471554 | 3/1979 | France . |
| 2541756 | 2/1983 | France . |

*Primary Examiner*—Samuel Scott
*Assistant Examiner*—Noah Kamen
*Attorney, Agent, or Firm*—Hovey, Williams, Timmons & Collins

[57] ABSTRACT

A draft operated fireplace insert may be used to circulate heated air from one room to another or from the exterior of a building into the interior. The fireplace insert is fitted so that a set of louvers are located over a ventilated ash pit of the fireplace, permitting air to be selectively introduced into the combustion zone of the fireplace. Air is circulated through a channel extending beneath a floor plate and behind a rear plate of the fireplace insert. Alternately, air is drawn through fuel-supporting hollow andirons extending beween the floor plate and the rear plate. A vertically shiftable damper plate controls the flow of air through the channel and the andirons.

4 Claims, 3 Drawing Sheets

DRAFT OPERATED FIREPLACE INSERT

BACKGROUND OF THE INVENTION

1. Field of the Invention. A draft operated fireplace insert circulates heated air through natural convection to most effectively heat the building in which it is placed. The insert is compact, economical to produce, and useful in heating and circulating air from either the outside of the building into a room or from one room to another inside the building.

2. Description of the Prior Art.

The fireplace is a common architectural feature of most of today's homes. With the need to look to renewable energy sources, the fireplace is no longer merely an aesthetically pleasing addition to a room but is an important source of home heating.

Ever since the Franklin stove, ways of improving the efficiency of the fireplace have been sought. These methods have variously included restricting the airflow through the fireplace, circulating air around the fireplace into the room(s) to be heated, and improving the radiation of heat from a fireplace or wood-burning stove into the area to be heated by reflectors and radiators. By way of further improvements, fireplace inserts have been constructed wherein outside air has been ducted into the fireplace and then into the room to be heated or fans have been used to increase the airflow around the fireplace insert.

While these prior devices have been largely successful in improving the efficiency of the fireplace as a heating unit, the fireplace inserts are usually massive structures, and thus difficult to transport and expensive to produce. Further, these units lack adequate air circulation for the ignition of the fire, and have failed to maximize the heating surfaces around the fireplace insert for heating the structure. Specifically, existing fireplace inserts fail to effectively utilize the area at the base of the fireplace as a source of heat for the room.

SUMMARY OF THE INVENTION

The problems outlined above are in large measure solved by the fireplace insert in accordance with the present invention. The insert hereof is relatively compact, provides for ample fresh air delivery to the fireplace during ignition, and optimally uses the bottom and rear of the fireplace along with the andirons located therein as heat gathering and transferring sources.

The fireplace insert broadly includes a pair of andirons, a channel passing underneath and behind the ignition area, a damper plate for controlling the passage of air through the channel, and a louvered ash pit in the bottom of the insert. The andirons are chambered to permit the circulation of air therethrough between the rear and the floor of the insert. The air also circulates underneath and behind the ignition area to allow the heat generated by the fire to be transfered to the circulating air. The floor of the insert is provided with a grate which permits access to an ash pit. The ash pit enables removal of the ashes from the fireplace and provides a source of air to enhance ignition of the fuel when the louvers in the ash pit are opened.

The insert may be mounted in a fireplace with a back wall on either the exterior or interior of the building. When the back wall of the fireplace is on the exterior of the building, the outside air is circulated from the back of the fireplace and underneath the insert into the room in which the fireplace is located. Alternately, the back of the fireplace may be on an interior wall of a building, in which case the air is circulated underneath and behind the rear plate of the insert into the room behind the back wall of the fireplace.

DETAILED DESCRIPTION OF THE DRAWINGS

Figure 1:
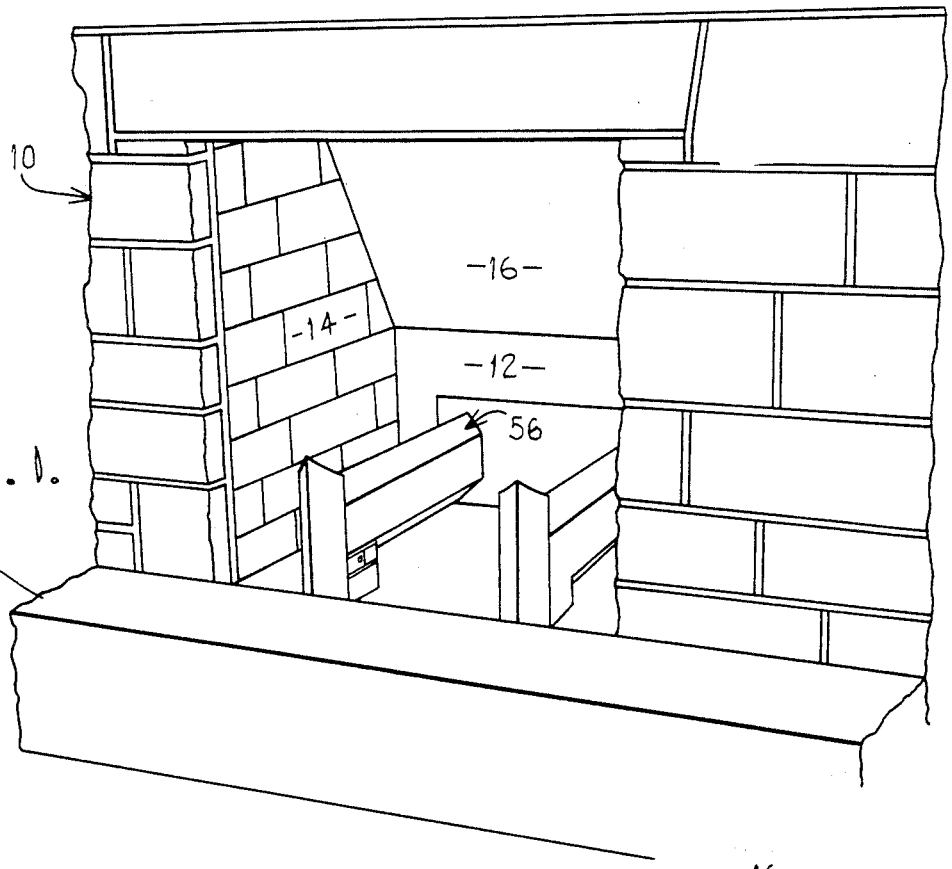
FIG. 1 is a perspective view of the fireplace insert in accordance with the present invention installed in a fireplace.
Figure 2:
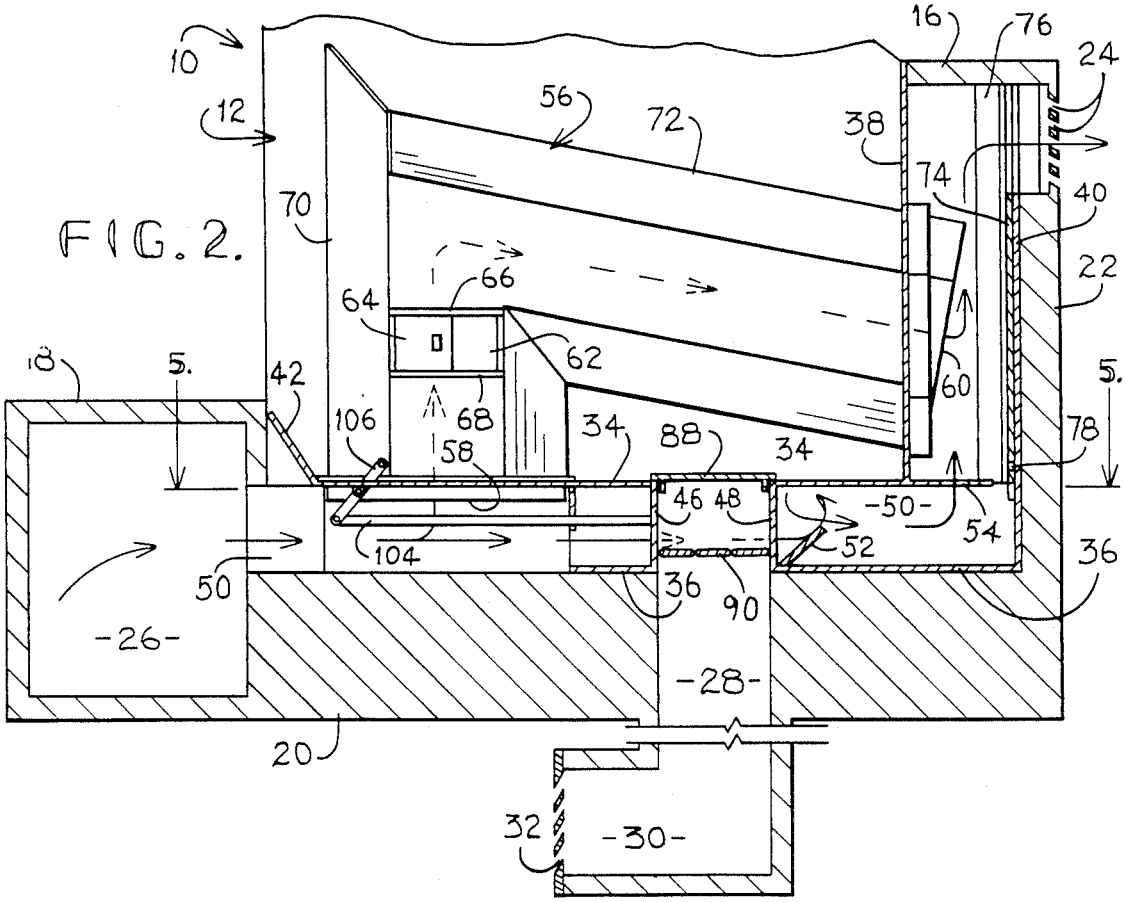
FIG. 2 is a vertical sectional view of the fireplace insert taken along a vertical plane bisecting the insert between the andirons and through the ash pit and showing the circulation of air when the back wall of the fireplace is an interior wall of a building.

In a fireplace 10 built into a residential building, a draft operated fireplace insert 12 is provided. The fireplace 10 includes a pair of side walls 14, a rear wall 16, a hearth 18 at the front of the fireplace, a chimney (not shown), and a floor 20 and back wall 22 as shown in FIG. 2. The fireplace 10 is conventionally constructed of firebrick or other masonry which is fire-resistant. The back wall 22 is provided with a series of openings 24 to permit the flow of air therethrough. The hearth 18 is constructed with an opening (not shown) at either or both ends in order to permit the flow of air through the hollow interior 26 of the hearth 18. The top of hearth 18 is raised above the floor 20 of the fireplace 10. The floor 20 is provided with an ash pit 28 with a horizontal component 30 and a ventilated ash door 32.

Figure 3:
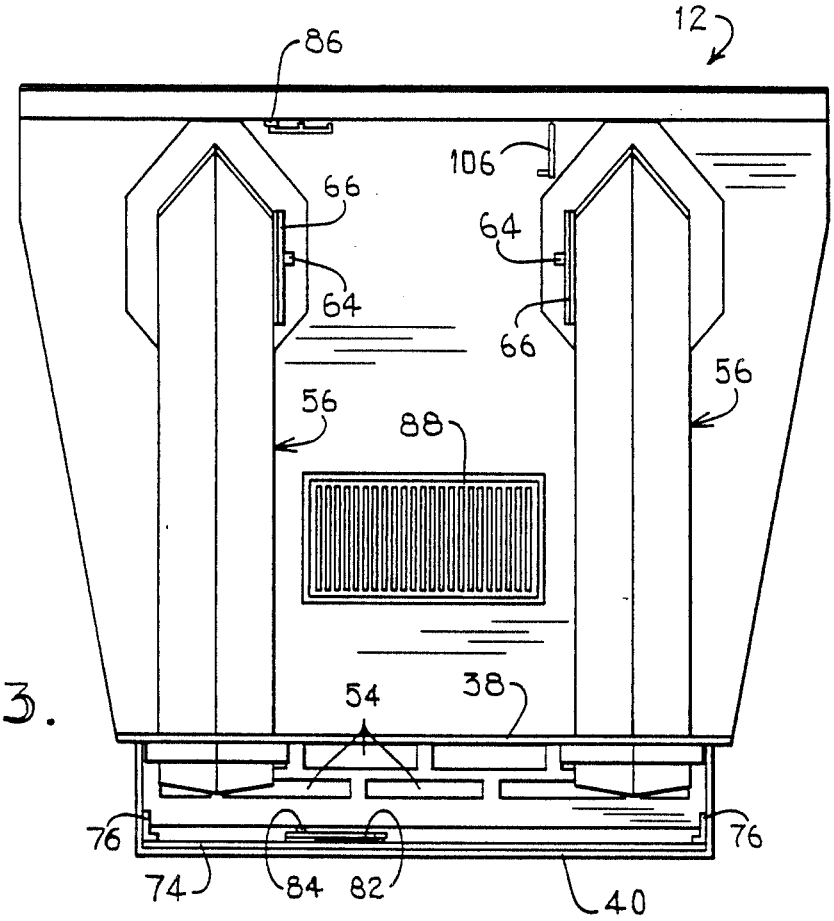
FIG. 3 is a top plan view of the fireplace insert hereof showing the ash grate, andirons and the damper plate and control handle.

The insert 12 is constructed to fit within the fireplace 10 and is defined broadly by floor plate 34, base plate 36, rear plate 38 and back plate 40. The floor plate 34 is angled up and against the top of hearth 18 to form a threshold 42. A forward wall 44, along with ash walls 46, 48 support floor plate 34 above base plate 36 and provide a channel 50 for the passage of air therebetween. A baffle 52 is located at the rear of ash wall 48 to slow the passage of air through the channel 50. The channel 50 extends up along the back plate through the space between back plate 40 and floor plate 34 and between rear plate 38 and back plate 40. As shown in FIG. 3, a series of vents 54 are also provided in floor plate 34 to enhance the vertical flow of air at the rear of the insert.

As an alternate route of air flow, air passing through channel 50 may travel through andiron 56. Two andirons 56 are provided, each of which is chambered for the passage of air through its front opening 58 and rear opening 60. Each andiron 56 is provided with an outlet 62 which may be covered by outlet door 64. Door 64 rides along flanges 66, 68 and is thereby held in place.

Outlet 62 is located on riser 70 which extends above log rest 72. Log rest 72 extends rearwardly from the riser 70 and slopes down to the point at which it enters rear plate 38. Rear plate 38 thus supports log rest 72 and is provided with an opening through which rear opening 60 extends.

At the rear of the insert 12, a damper plate 74 is inserted behind keepers 76. Keepers 76 retain damper plate 74 in juxtaposition to back plate 40 but permit damper plate 40 to shift vertically. A horizontal slot 78 is provided in the lower portion of damper plate 74 and permits pin 80 to move therein. Pin 80 is connected to damper plate control arm 82 which is mounted on shaft 84, so that the arm 82 follows the pivotal movement of shaft 84. Shaft 84 extends forwardly underneath floor plate 34 to connect with control handle 86. Pivoting of the control handle 86 thus produces corresponding pivoting of shaft 84 and arm 82. Shaft 84 is pivotally mounted in openings in rear plate 38, baffle 52 and forward wall 44.

Figure 5:
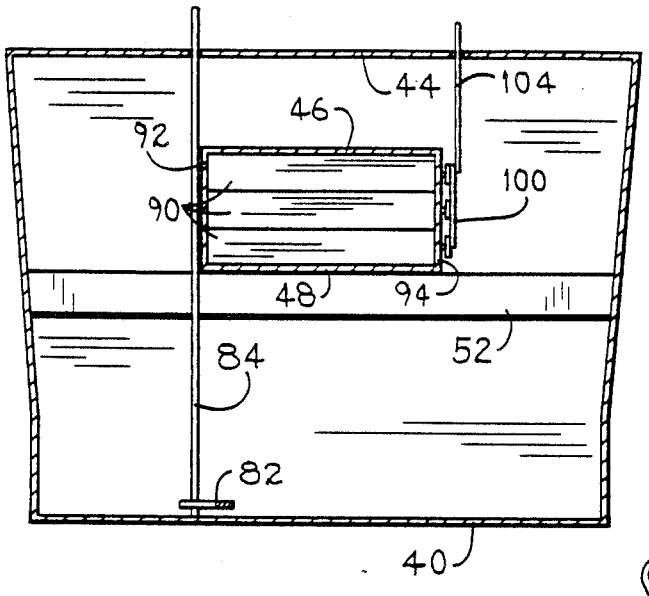
FIG. 5 is a fragmentary horizontal sectional view taken along line 5—5 of FIG. 2 showing the baffle, damper plate control arm and louvers.
Figure 6:
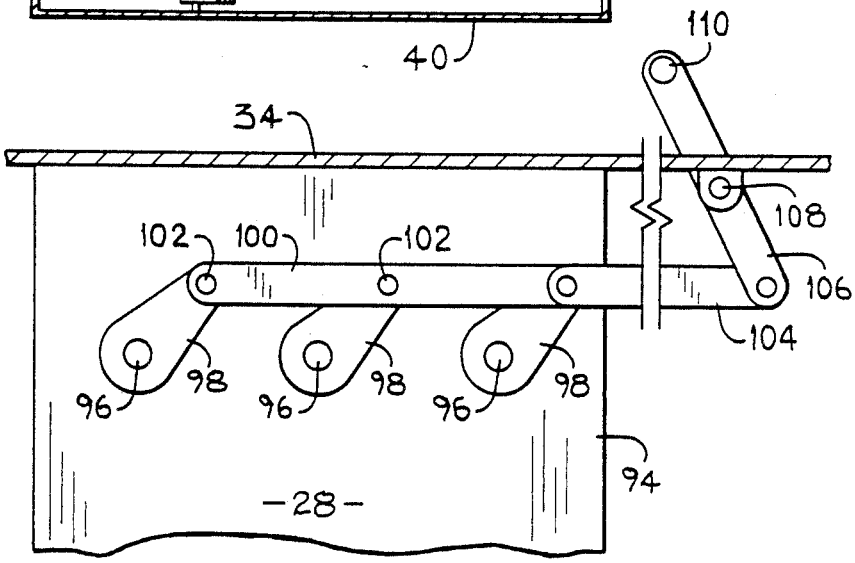
FIG. 6 is an enlarged fragmentary side elevational view of the louver operating linkage.
Figure 7:
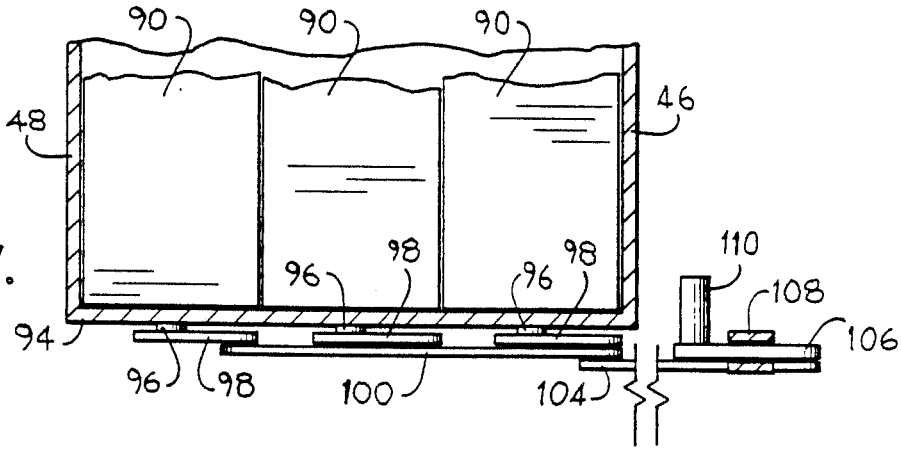
FIG. 7 is an enlarged fragmentary top plan cross-sectional view of the louvers and louver operating linkage in accordance with the present invention.

A grate 88 is fitted into the top of ash pit 28 and over louvers 90. Louvers 90 extend laterally across ash pit 28 and are juxtaposed in combination to block the passage of air or ashes through the ash pit 28 between ash walls 46, 48 and side walls 92, 94 when in the horizontal position as shown in FIG. 5. Each louver is pivotally mounted on one end of journal 96 as shown in FIGS. 6 and 7. In turn, a series of cranks 98 corresponding to each louver 90 are mounted on the opposite end of the journals 96. A louver operating linkage 100 in turn interconnects each crank 98 through link pin 102 and maintains them in parallel orientation. The linkage 100 is pivotally connected to the cranks 98 so that the cranks 98 pivot on journals 96 in unison. A rod 104 extends forwardly through forward wall 44 and operably coupled linkage 100 to toggle 106. Toggle 106 extends above and below floor plate 34, is pivotally mounted on bearing 108, and is provided with grasping finger 110.

The insert 12 is placed in a fireplace 10 which has been constructed to take advantage of the features and structure disclosed herein. Thus, the fireplace would have been constructed with a hearth 18 having a hollow interior 26 therein and which has openings to permit the flow of air either into or out of the hearth. Further, the hearth 18 would have been constructed higher than the floor 20 of the fireplace and with an opening into the fireplace 10 as shown in FIG. 2. The back wall 22 of the fireplace could be constructed on either an interior wall or an exterior wall. In either event, openings 24 would be provided in back wall 22 to permit the flow of air therethrough. Finally, an ash pit 28, which would also serve as an air passageway, would be constructed in the bottom of the fireplace 10 and be fitted with a ventilated door 32.

In operation, firewood or other suitable combustible fuel would be placed on andirons 56 and thereafter ignited. During the initial firebuilding stage of use, outlet door 64 on each andiron 56 can be opened to enhance the flow of air directly to the fire. Further airflow to the fire may be selectively obtained by moving toggle 106 to simultaneously pivot louvers 9 from a closed horizontal position in ash pit 28 to an open vertical position. Ash pit 28 thus acts as a separate air passageway from beneath floor plate 34 and base plate 36 across channel 50 into the area of combustion within the fireplace 10. When air flow to the fire is to be reduced, outlet door 64 is closed over outlet 62 and the louvers 90 are shifted back into the horizontal, closed position.

Figure 4:
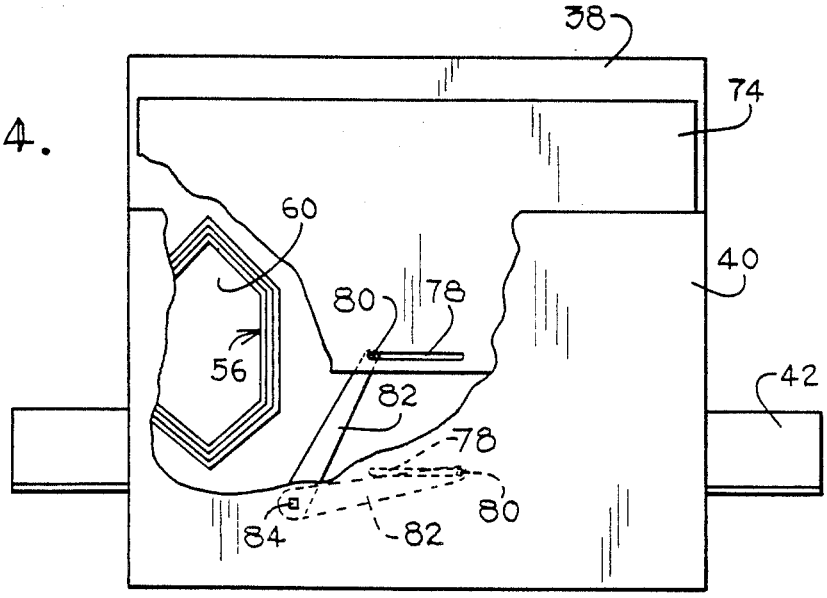
FIG. 4 is a rear elevation view of the fireplace insert hereof with a portion of the rear plate cut away to show the andiron outlet and damper plate control arm.

To provide for heat circulation, control handle 86 is pivoted to move arm 82 and lower damper plate 74. As shown in FIG. 4, when arm 82 pivots in a clockwise direction, pin 80 moves laterally along slot 78 and damper plate 74 is thereby lowered. The lowered position of the slot 78 on damper plate 74 is shown in phantom in FIG. 4, and the damper plate 74 itself is shown in the lower position in FIG. 2.

When damper plate 74 is lowered, air is free to circulate through openings 24. When back wall 22 is an exterior wall, the colder exterior air will flow into the openings 24, circulate through andirons 56 and between floor plate 34 and base plate 36 where the air is then heated by the fire before exiting through channel 50 into the interior 26 of hearth 18 and thence into the room. Threshold 42 prevents any heated air from returning into the fireplace 10. Baffle 52 creates turbulence in the air flow, thereby permitting additional heat to be transferred from floor plate 34 and base plate 36 to the circulating air.

When back wall 22 is an interior wall, the difference in the density of the air between the connecting rooms is insufficient to force substantial quantities of air down through openings 24 as set forth in the preceeding paragraph. Instead, as the air is heated beneath floor plate 34, through andiron 56 and along back wall 38, it will rise and exit through openings 24. Thus, when back wall 22 is an interior wall, air is drawn through interior 26 of hearth 18, and through channel 50 as indicated by the arrows in FIG. 2. As the air flows through andirons 56 and beneath floor plate 34 it is heated, and then rises between rear plate 38 and back plate 40 before exiting through openings 24. The airflow will continue in the path indicated by the arrows so long as the temperature of the insert is higher than the temperature of the ambient air, or until damper plate 74 is raised to block the flow of air between back wall 22 and rear wall 16 through openings 22.

I claim:

1. A draft operated fireplace insert for placement into a fireplace of a building, the fireplace having a floor, a passageway in the floor, side walls, a front and back wall, a chimney, and an opening in the back wall capable of transmitting air therethrough comprising:

a floor plate spanning the width of a fireplace and extending rearwardly from the front of the fireplace but not contacting the back wall of the fireplace;

means supporting the floor plate above the floor of the fireplace;

a rear plate extending upwardly from said floor plate to enclose the rear of the fireplace and defining both a channel for the passage of air beneath the floor plate and between the rear plate and the back wall of the firepplace and a combustion zone above the floor plate and forward of the rear plate;

a pair of hollow andirons extending up through openings in the floor plate and rearwardly through openings in the back plate to provide an alternate route for the passage of air;

means for regulating the passage of air through the andirons and through said channel; and means for selectively introducing air from beneath the floor through the passageway into the combustion zone of the fireplace above the floor plate, means for regulating the passage of air through the andirons and through said channel including a vertical plate adapted for shiftable movement across the opening in the back wall; and means for selectively introducing air from beneath the floor through the passageway into the combustion zone of the fireplace above the floor plate including louvers pivotal between a first closed position and a second, open position.

2. A fireplace inset as set forth in claim 1 wherein said plate is shiftable between a first and second position by control means located adjacent the front of said fireplace.

3. A fireplace insert as set forth in claim 2 wherein the front of the fireplace comprises a hollow hearth open at its ends extending above the floor of the fireplace and the hearth is provided with an opening into the fireplace, said floor plate extending forwardly to said hearth to enclose the opening.

4. A fireplace insert as set forth in claim 3 wherein the back wall of the fireplace is an interior wall of the building.

* * * * *